US005251935A

United States Patent [19]

Bottiglièri

[11] Patent Number: 5,251,935

[45] Date of Patent: Oct. 12, 1993

[54] COMBINATION BINDER/BOOK REST

[76] Inventor: Peter Bottiglièri, 20841 Stoney Ave., Maple Ridge, British Columbia, Canada, V2X 7T2

[21] Appl. No.: 878,811

[22] Filed: May 5, 1992

[51] Int. Cl.[5] ..... B42D 3/18

[52] U.S. Cl. ..... 281/45; 281/33; 402/73

[58] Field of Search ..... 281/33, 45; 402/73

[56] References Cited

U.S. PATENT DOCUMENTS

| | | | |
|---|---|---|---|
| 875,220 | 12/1907 | Smith . | |
| 1,724,492 | 8/1929 | Manus . | |
| 2,982,568 | 5/1961 | Wolfe | 281/33 |
| 3,366,359 | 1/1968 | Wolf et al. | 248/447 |
| 4,105,182 | 8/1978 | Jacobson | 248/459 |
| 4,295,624 | 10/1981 | Granada | 248/456 |
| 4,886,231 | 12/1989 | Doerksen | 248/455 |

*Primary Examiner*—Paul A. Bell
*Attorney, Agent, or Firm*—Barrigar & Oyen

[57] ABSTRACT

A combination binder/book rest having front and rear covers (10, 12) pivotally connected along opposed edges of a spine (14). A support element (52) is pivotally connected to the front cover to support the front cover at a selected angle of inclination. A page retention mechanism (86, 88; 98, 100; 106, 108) rotatably connected to the spine bears against pages of a book (110) supported by the inclined front cover. An adjusting mechanism (56, 74, 76) is provided for adjusting the cover's angle of inclination. When not functioning as a book rest, the device may be configured in a storage position in which it functions as a conventional three-ring loose-leaf binder. The binder's contents (27) may be easily removed for reference while the device is functioning as a book rest. The book rest aspect of the device provides improved support by utilizing one of the binder's covers to support the open book. The page retention mechanism may be adjusted to accommodate books of many sizes.

15 Claims, 6 Drawing Sheets

FIG. 1
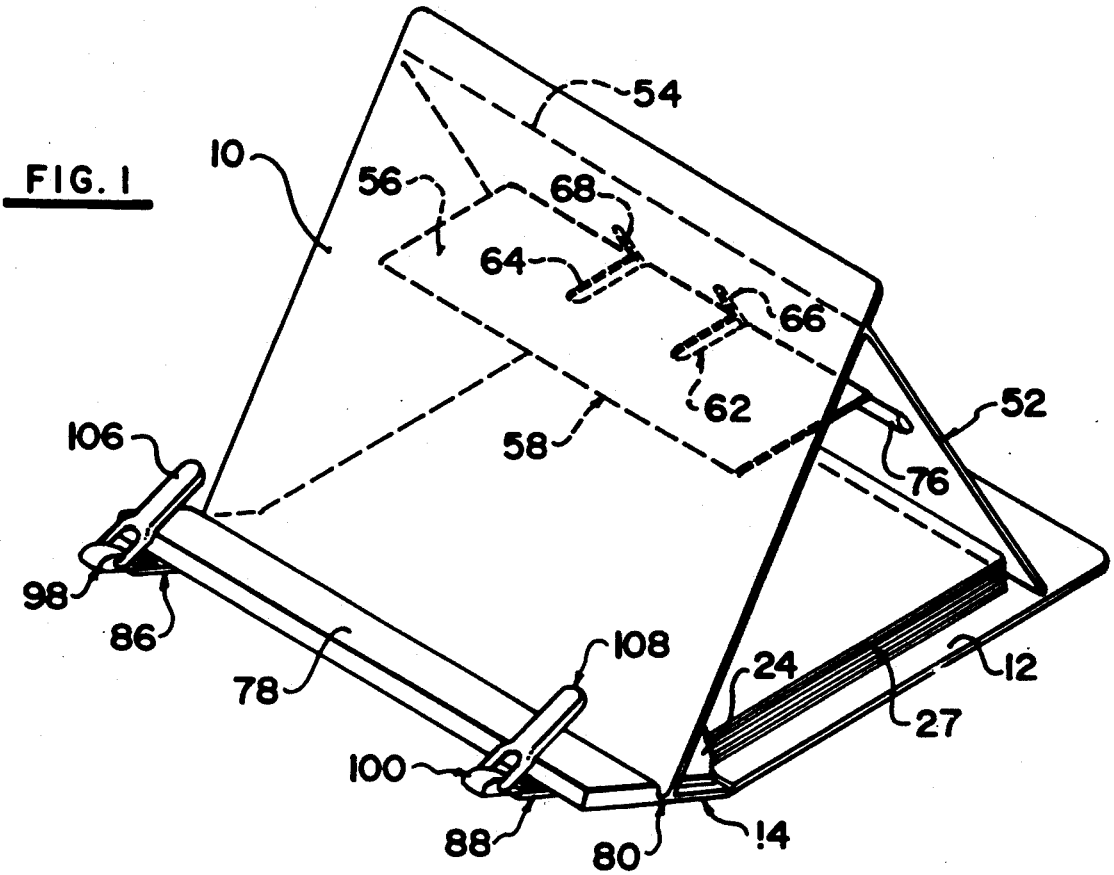
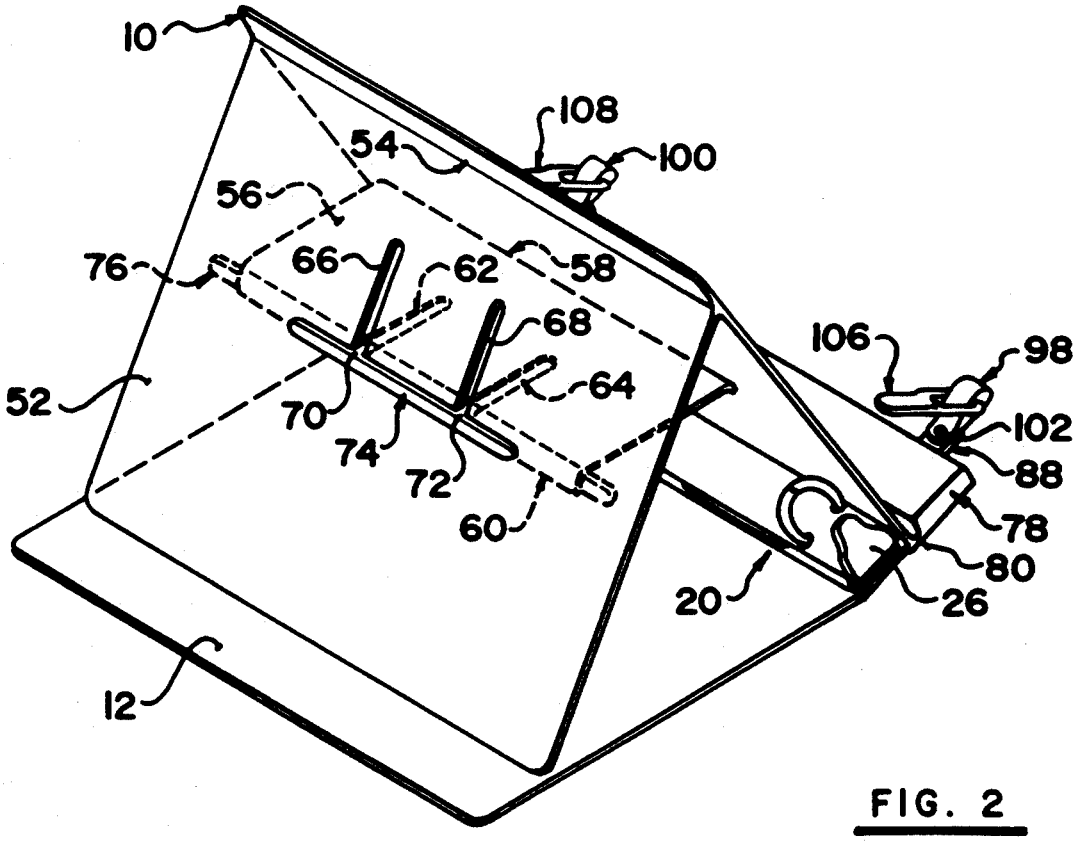
FIG. 2

FIG. 3
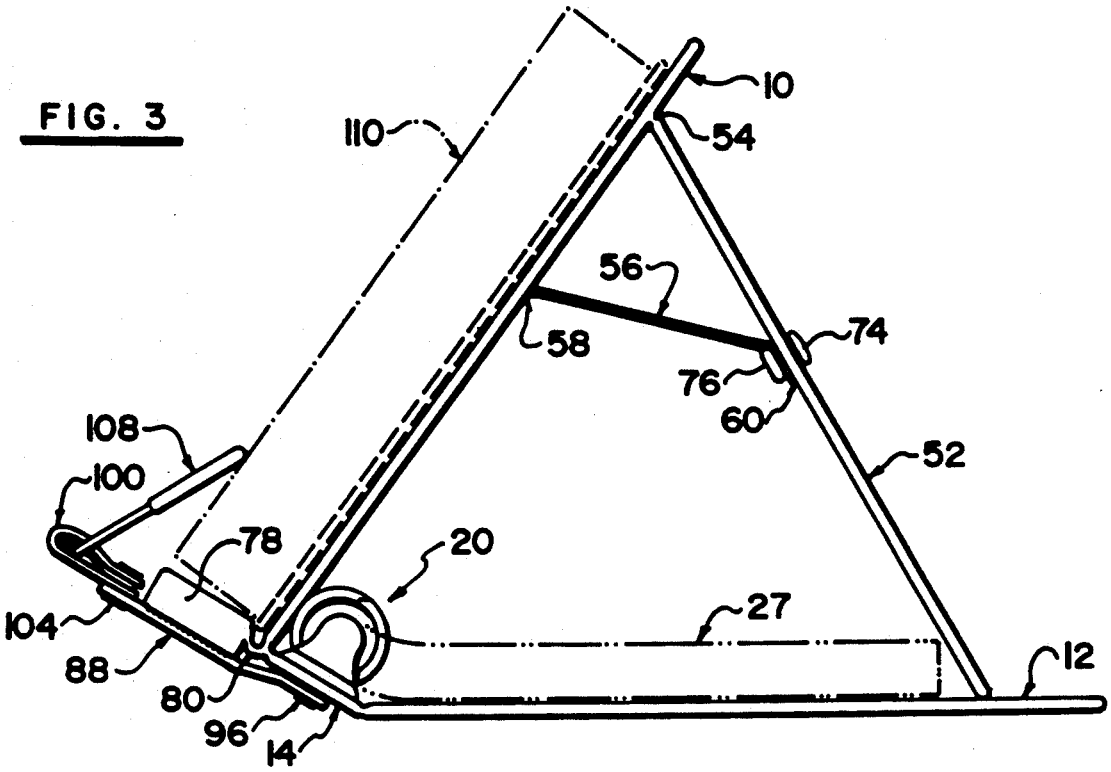
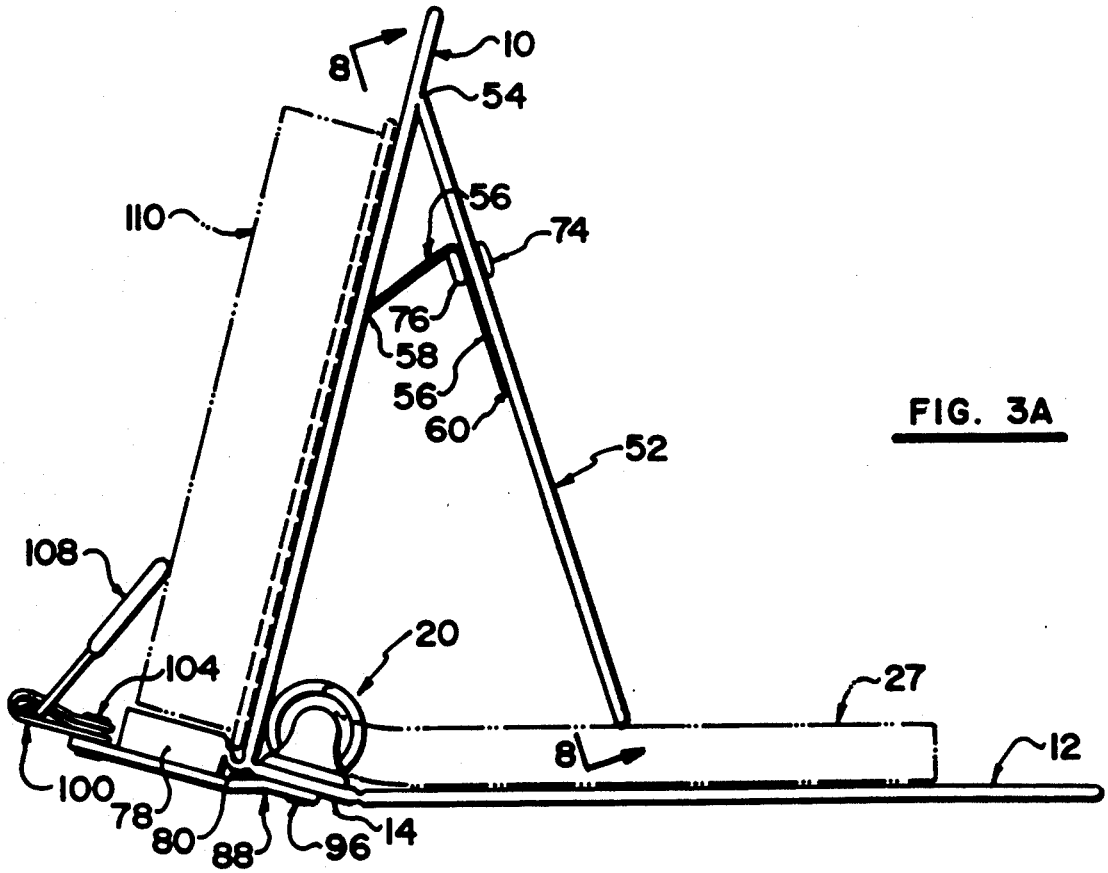
FIG. 3A

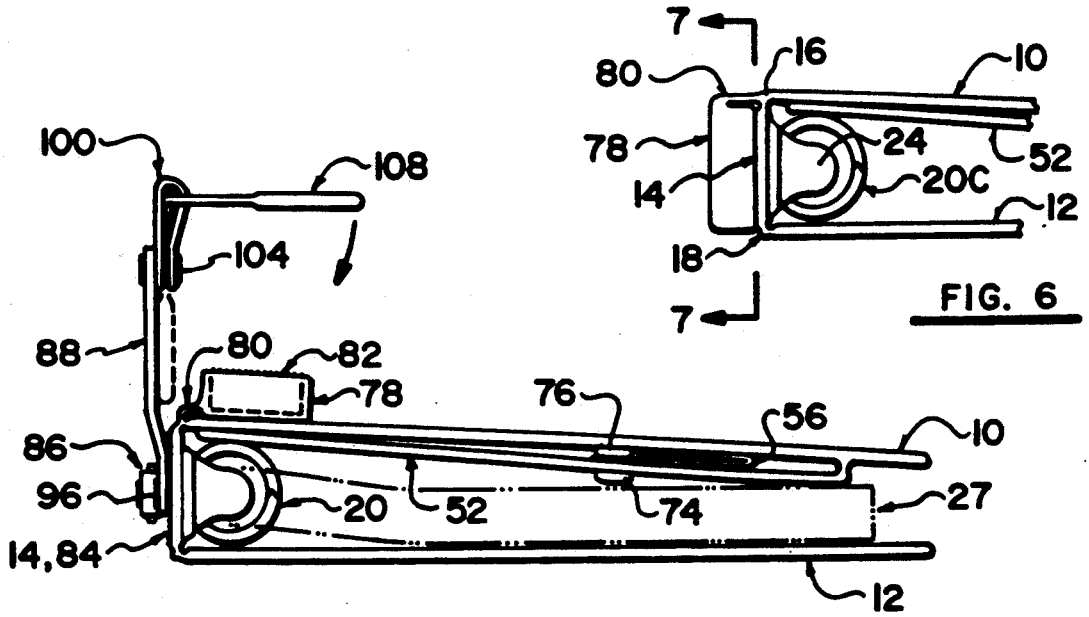
FIG. 6
FIG. 4
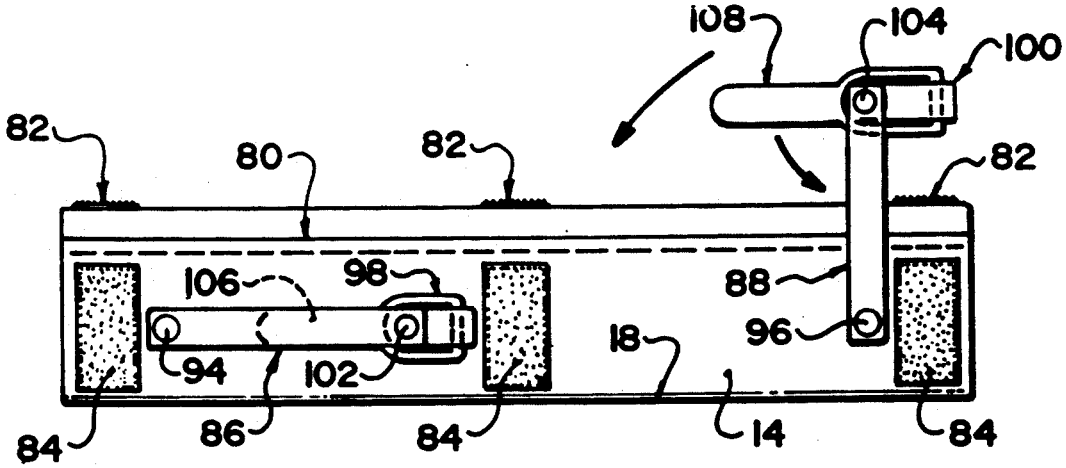
FIG. 5
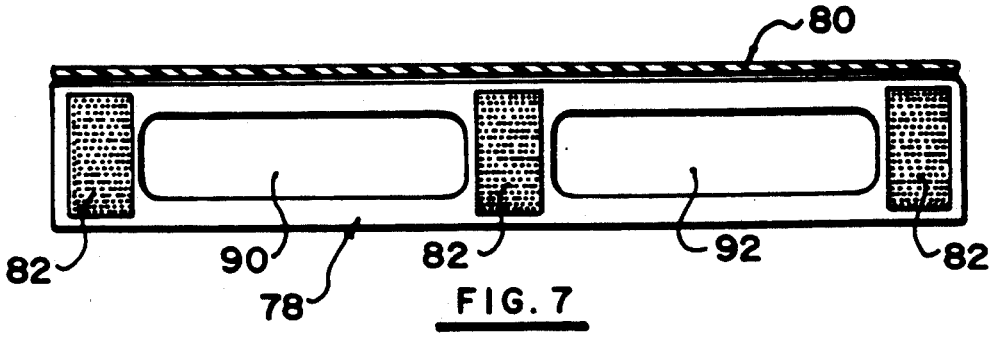
FIG. 7

COMBINATION BINDER/BOOK REST

FIELD OF THE INVENTION

This application pertains to loose-leaf binder adapted to function as a book rest.

BACKGROUND OF THE INVENTION

The desktop space provided to students in a typical school classroom is relatively small. In particular, students do not have a great deal of desktop space on which to spread out material such as reference texts, notebooks, etc. Students may also encounter limited work space situations away from the classroom, in libraries, at home, etc.

A book rest can be used to support an open book on a desktop in an upwardly inclined position to leave more desktop space available for notebooks, etc. than if the open book were laid flat on the desktop. However, a separate book rest device is not an ideal solution because, in addition to having to carry text books, note books and other school supplies, the student would also have to carry the book rest device between various work places (class room, library, home, etc.) in order to have it available for ready use. It is also questionable whether the relatively cramped desk storage space typically provided to students would suffice for storing a separate book rest device when not in use. These problems may be overcome by integrating a book rest device into a three-ring loose-leaf binder. Students commonly use such binders and typically carry them between their various work places.

U.S. Pat. No. 3,366,359 issued Jan. 30, 1968 for an invention of Wolf et al entitled "Combination Notebook and Book Stand" integrates a book rest into a conventional three-ring loose-leaf binder of the type commonly used by students. In particular, a book rest element is slidably mated to the binder's ring holder strip. The book rest element may be slidably extended away from the upper end of the binder to reveal a pair of arms which are then pivoted into position to form an inclined book rest. However, the Wolf et al device supports the book only over a narrow vertical region. The present invention improves the book support capability of a combination binder/book rest by utilizing one of the binder's covers to support the book.

SUMMARY OF THE INVENTION

In accordance with the preferred embodiment, the invention provides a combination binder/book rest having front and rear covers pivotally connected along opposed edges of a spine. A cover support is pivotally connected to the front cover to support the front cover at a selected angle of inclination. A page retainer rotatably connected to the spine bears against the pages of an open book laid against and supported by the inclined front cover. Preferably, an adjusting means is provided for adjusting the cover's angle of inclination.

The adjusting means may be a flexible membrane connected between the front cover and a planar member which serves as the cover support means. First and second members may be connected through the planar member and through the flexible membrane for slidable movement of the first member over one surface of the planar member and for slidable movement of the second member over an opposed surface of the flexible membrane, to vary the distance the flexible membrane extends between the front cover and the second member.

The page retention means may take the form of first and second arms rotatably connected near opposed ends of the spine for movement between storage positions in which the arms overlie the binder's spine; and, operating positions in which the arms project outwardly from the spine. First and second fingers may be pivotally connected to the ends of the respective arms for movement between storage positions in which the fingers overlie the arms; and, operating positions in which the fingers project away from the arms. Advantageously, first and second spring clips are rotatably connected between the ends of the respective arms and fingers to urge the fingers toward the spine when the arms and fingers are in their respective operating positions.

A cover is pivotally connected to the spine such that the arms, fingers and spring clips are covered when in their respective storage positions. The cover also serves to support the base of the book when the arms are in their operating positions. Compartments may be provided in the cover to receive the arms when in their storage position.

Advantageously, a releasable coupling means is provided for releasably coupling a three-ring loose-leaf binding structure to the spine. The releasable coupling means comprises a retaining plate fixed to the spine, a base plate fixed to the binding structure, and means for slidably engaging the base plate with the retaining plate. Preferably, a pair of tabs are provided on the retaining plate and a pair of protrusions are provided on the base plate. The protrusions are slidably aligned beneath the tabs to hold the base plate on the retaining plate. By sliding the base plate relative to the retaining plate until the protrusions clear the tabs, one may remove the binding structure and its contents from the binder for reference while a book is supported on the book rest.

BRIEF DESCRIPTION OF THE DRAWINGS

FIG. 1 is an oblique front isometric illustration of combination binder/book rest constructed in accordance with the embodiment of the invention.

FIG. 2 is an oblique rear isometric illustration of the combination binder/book rest of FIG. 1.

FIG. 3 is a side e view of the combination binder/-book rest of FIGS. 1 and 2.

FIG. 3A is similar to FIG. 3, and shows how the angle of inclination of the book rest may be adjusted.

FIG. 4 is a side elevation view of the combination binder/book rest, showing the book rest folded flat with the book supporting arms being returned to their storage positions.

FIG. 5 is an elevation view of the binder spine, showing the book supporting arms being returned to their storage positions.

FIG. 6 is a side elevation view of a portion of the combination binder/book rest, showing the book supporting arm cover in its closed position.

FIG. 7 is a section view of the book supporting arm closure member, taken with respect to line 7—7 of FIG. 6.

DETAILED DESCRIPTION OF THE PREFERRED EMBODIMENT

Figure 8:
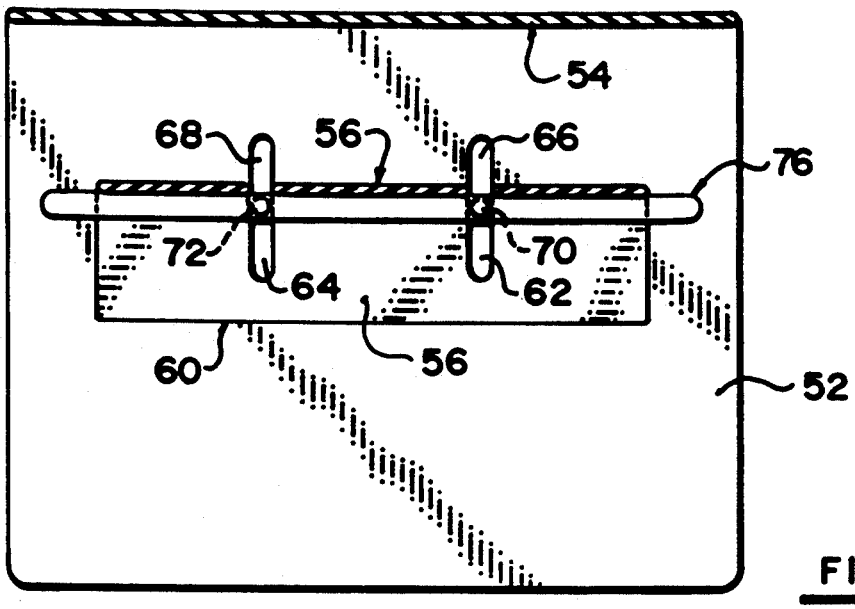
FIG. 8 is a section view of the book rest support element, taken with respect to line 8—8 of FIG. 3A.
Figure 9:
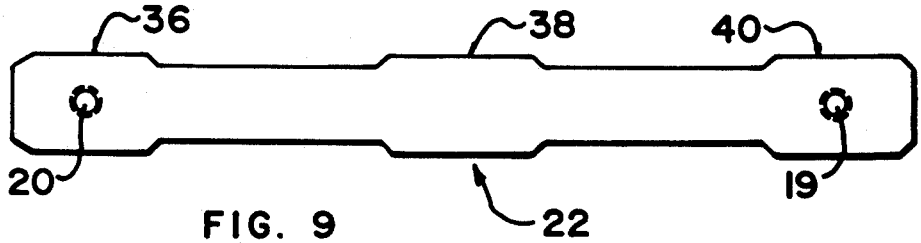
FIG. 9 is a plan view of the loose-leaf support structure base plate.
Figure 11:
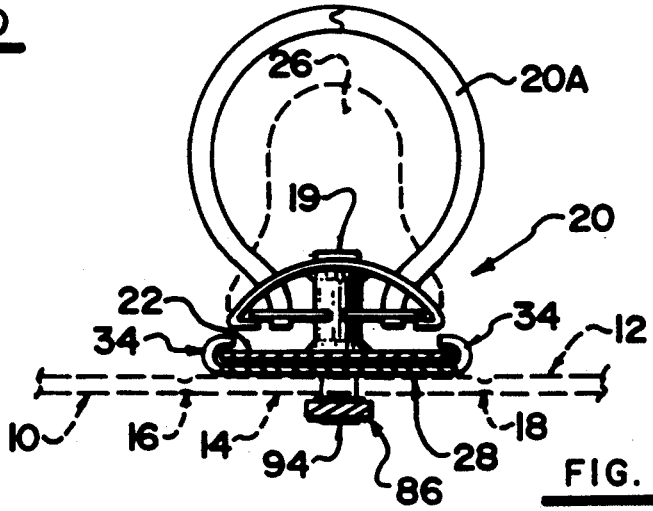
FIG. 11 is a section view of the loose-leaf support structure, taken with respect to line 11—11 of FIG. 12.
Figure 12:
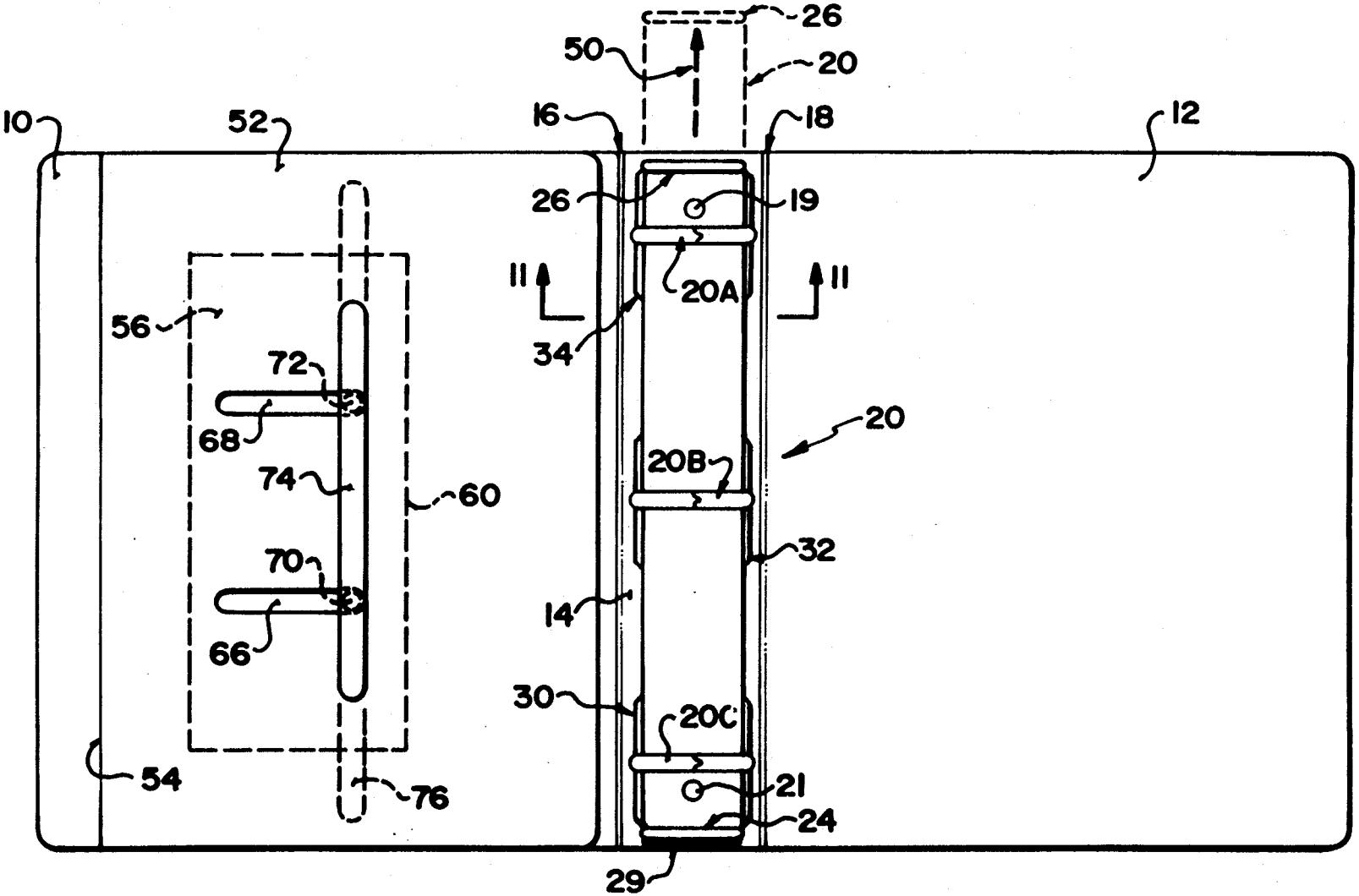
FIG. 12 is a plan view of the combination binder/-book rest showing the binder opened for removal of the three-ring structure from the binder.

As best seen in FIGS. 3 and 12, the invention provides a three-ring type loose-leaf binder having a front cover 10, a rear cover 12 and a spine 14. Covers 10, 12 and spine 14 are conventional and may for example be formed of vinyl-encased cardboard. Covers 10, 12 are welded to spine 14 along seams 16, 18 which flex to permit opening and closing of covers 10, 12 relative to spine 14. A conventional three-ring structure 20 (FIG. 11) having rings 20*a*, 20*b*, 20*c* is attached by rivets 19, 21 to base plate 22 (FIG. 9). Rings 20*a*, 20*b* and 20*c* are opened and closed in conventional fashion with the aid of end tabs 24, 26 for addition or removal of loose-leaf sheets 27.

Figure 10:
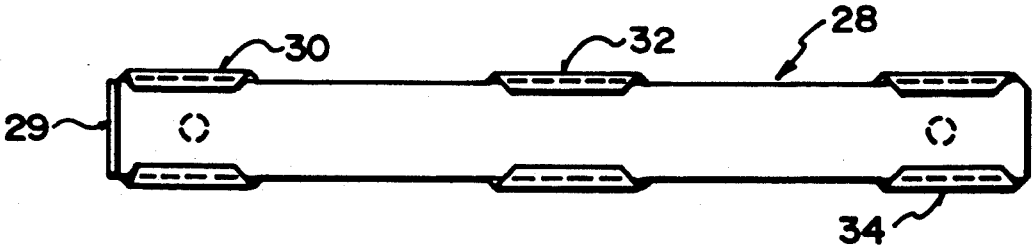
FIG. 10 is a plan view of the base plate retaining plate.

A retaining plate 28 (FIG. 10) having an upwardly protruding stop tab 29 is riveted to the inside surface of spine 14. Spaced pairs of inwardly curved tabs 30, 32, 34 are provided at the ends and mid-section of retaining plate 28. Base plate 22 is sized to slide between the upper surface of retaining plate 28 and the undersides of tabs 30, 32, 34. Protrusions 36, 38, 40 provided on base plate 22 are aligned beneath tabs 30, 32, 34 respectively when base plate 22 is fully engaged within retaining plate 28. Protrusions 36, 38, 40 bear against tabs 30, 32, 34 with sufficient frictional force to prevent base plate 22 slipping free of retaining plate 28. The student may however remove three-ring structure 20 with loose-leaf sheets 27 intact by holding one of covers 10 or 12 and pushing three-ring structure 20 upwardly in the direction of arrow 50 (FIG. 12) until protrusions 36, 38, 40 have been extended beyond tabs 30, 32, 34. Three-ring structure 20, base plate 22 and loose-leaf sheets 27 may then be lifted up and away from retaining plate 28, thus allowing the student to refer to the loose-leaf material while employing the device as a book rest in the manner which will now be described.

As best seen in FIGS. 1, 2 and 3, a "cover support means", namely support element 52 is pivotally attached to the inside surface of front cover 10. Support element 52 may be a vinyl-encased cardboard member similar to those used to form covers 10, 12; and, the pivotal attachment of support element 52 to front cover 10 may take the form of a welded seam 54 similar to seams 16, 18. A flexible membrane 56 extends between the undersides of front cover 10 and support element 52. Flexible membrane 56 may be made of vinyl or similar tough material and fixed to front cover 10 by welding along seam 58. The opposite edge of flexible membrane 56 is welded to the underside of support element 52 along seam 60. A pair of slots 62, 64 are provided in flexible membrane 56. A mating pair of slots 66, 68 are provided in support element 52. Arms 70, 72 (FIG. 2) project through aligned slot pairs 62, 66 and 64, 68 respectively. Arms 70, 72 interconnect bars 74, 76 which lie flat against the respective inner and outer surfaces of support element 52.

The arrangement aforesaid permits adjustment of the angle at which front cover 10 is inclined relative to rear cover 12. More particularly, after opening front cover 10, the student grasps support element 52 and pivots it away from cover 10, as shown in FIG. 3. If a steeper angle of inclination of front cover 10 is desired, then the student grasps bar 74 and slides it upwardly over the surface of support element 52, toward seam 54. Because bar 76 is fixed to bar 74 by arms 70, 72 this action also slides bar 76 upwardly toward seam 54. Flexible membrane 86 is entrained over the top of bar 76, such that bar 76 bears against the underside of flexible membrane 56. Accordingly, upward slidable movement of bar 76 shortens the segment of membrane 56 which extends between seam 58 and bar 76, thus adjusting the displacement between front cover 10 and support element 52 for inclination of front cover 10 at the desired angle. Arms 70, 72 are just long enough to allow the aforesaid sliding adjustment when a slight pressure is applied to bar 74. Otherwise, frictional forces between support element 52, flexible membrane 56 and bars 74, 76, serve to retain support element 52 in place, thus maintaining the desired angle of inclination of cover 10.

A cover 78 (which may also be vinyl-encased cardboard) is pivotally attached along the upper outer edge of spine 14 by welding along seam 80. Mating Velcro type closure members 82, 84 (FIGS. 5 and 7) are provided on the inner surface of cover member 78 and on the outer surface of spine 14. Closure members 82, 84 hold cover 78 firmly in the closed position depicted in FIG. 6 when the book rest feature of the invention is not in use. If it is desired to use the book rest feature, then cover 78 is pivoted away from spine 14 about seam 80 into the position shown in FIGS. 4 and 5. This action reveals book support arms 86, 88 in their respective storage positions depicted (in the case of arm 86) in FIG. 5. Recessed compartments 90, 92 (FIG. 7) are provided in the underside of cover 78 to accommodate the storage position of arms 86, 88.

Arms 86, 88 are pivotally fastened to spine 14 by rivets 94, 96 (which may be the same rivets used to attach retaining plate 28 to the inside surface of spine 14). Arms 86, 88 may be rotated about rivets 94, 96 respectively. A pair of spring clips 98, 100 are rotatably fastened to the free ends of arms 86, 88 by rivets 102, 104 respectively. Spring clips 98, 100 may thus rotate about the ends of arms 86, 88 respectively. A pair of fingers 106, 108 are pivotally held by spring clips 98, 100 respectively. Arms 86, 88; spring clips 98,100; and, fingers 106, 108 together comprise a "page retention means" for bearing against the pages of a book supported by cover 10 in its inclined position.

In operation, cover 78 is pivoted away from spine 14 as aforesaid to reveal arms 86, 88. The arms are then rotated about rivets 94, 96 into the position of arm 88 depicted in FIGS. 4 and 5. Fingers 106, 108 are then pivoted away from arms 86, 88 as in the case of finger 108 shown in FIG. 4. Front cover 10 is then raised and support element 52 is pivoted away from cover 10 to prop cover 10 at a desired angle of inclination by adjusting flexible membrane 56 as aforesaid. The aforesaid action moves spine 14 from the vertical position shown in FIG. 4 into the shallow, inclined position shown in FIGS. 1, 2 and 3. A book 110 (FIGS. 3 and 3A) may then be opened and placed upon cover 78 which rests upon and is supported by arms 86, 88. Cover 78 supports the base of book 110, and cover 10 supports the covers of book 110. The lower edges of book 110's covers protrude downwardly into a recess formed above seam 80 when cover 78 is pivoted away from spine 14 as aforesaid, thus anchoring book 110 in place.

Arms 86, 88 and/or fingers 106, 108 are then adjusted by rotating arms 86, 88 and/or pivoting fingers 106, 108 to bring the ends of fingers 106, 108 firmly into contact with the open pages of book 110. This arrangement provides a wide degree of adjustment. For example, smaller soft cover books are accommodated by rotating arms 86, 88 toward one another and pressing fingers 106, 108 onto the pages of book 110; whereas larger hard cover books are accommodated by rotating arms 86, 88 away from one another and drawing fingers 106, 108 rearwardly to clear the thicker accumulation of pages in the larger books. In either case, the spring action of spring clips 98, 100 urges fingers 106, 108 against the pages of book 110, thus stabilizing book 110 and holding it open with its pages flat for easy reference.

As will be apparent to those skilled in the art in the light of the foregoing disclosure, many alterations and modifications are possible in the practice of this invention without departing from the spirit or scope thereof. For example, support element 52 could be attached to rear cover 12 instead of to front cover 10, in which case cover 78 would be pivotally attached along the lower outer edge of spine 14. The invention may also be used to support items other than books. For example, an artist's easel could be supported.

Figure 13:
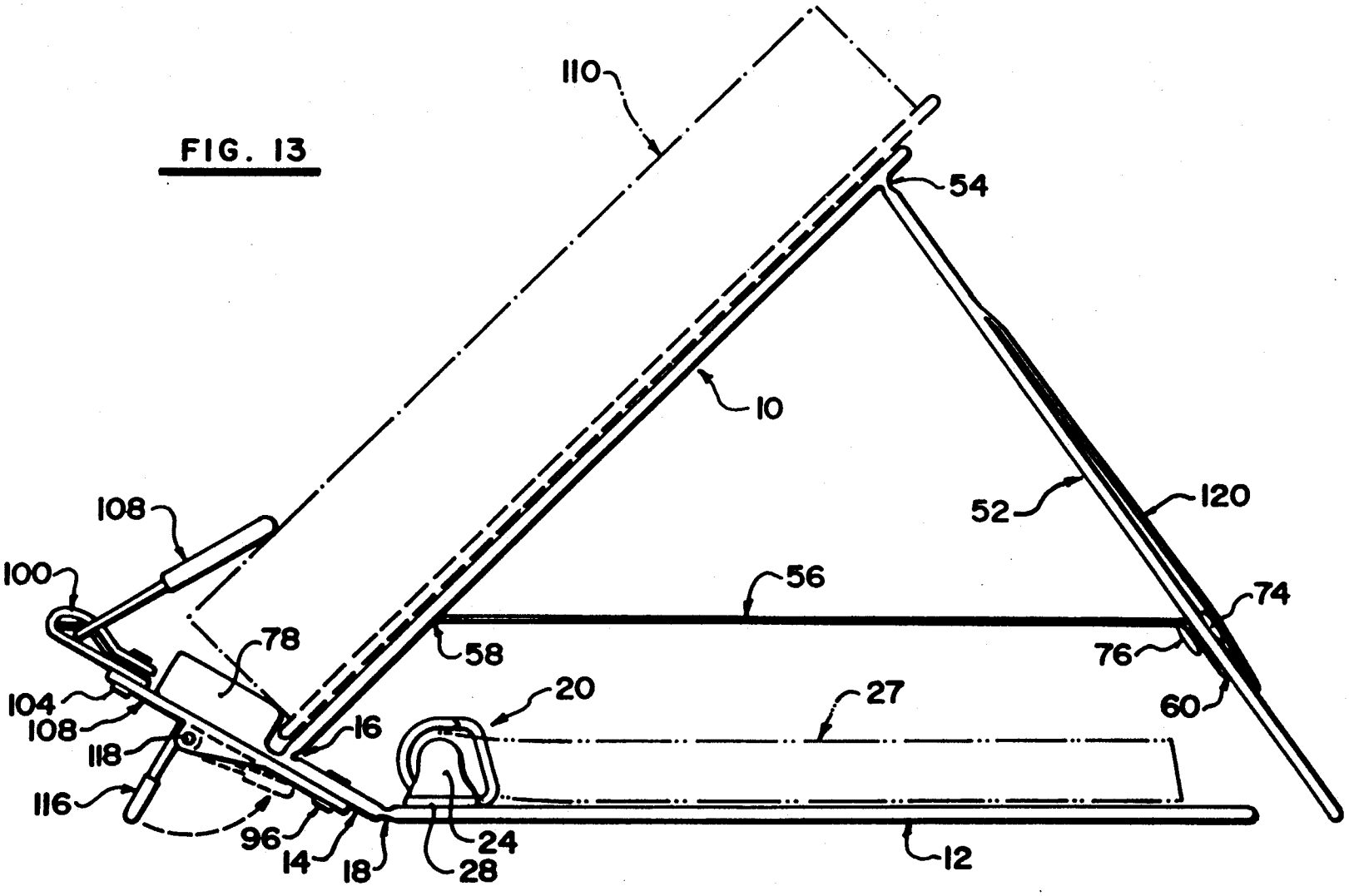
FIG. 13 is a side elevation view of an alternate embodiment of the invention and illustrates operation of the invention with a "D" ring style binder.

FIG. 13 illustrates additional refinements, including the provision of a protective flap 120 which overlies slots 66, 68 and bar 74, but may be lifted for access to bar 74. FIG. 13 also illustrates the provision of a support leg 116 pivotally coupled at 118 to the underside of book support arm 88. When leg 116 is pivoted downwardly into the position shown in FIG. 13, the lower end of leg 116 bears against the surface on which rear cover 12 lies, thereby preventing downward sagging of cover member 78 and book 110. A similar support leg (not shown) may be pivotally coupled to support arm 86. Such support legs are particularly useful if the invention is used with a "D" ring binder of the type shown in FIG. 13.

In a "D" ring binder, three-ring binding structure 20 is attached to the binder's rear cover 12, not to the binder's spine 14 as in the case of the binder illustrated in the FIGS. 1-12. Accordingly, in a "D" ring binder, three-ring structure 20 does not assist in preventing spine 14 or items coupled thereto, such as the book rest of the present invention, from sagging downwardly; whereas such sagging is somewhat inhibited in the binder of FIGS. 1-12 by the affixation of three-ring structure 20 to spine 14. The support legs also assist in supporting particularly heavy books, irrespective of the type of binder the invention is used with. When not in use the support legs are folded into the storage position illustrated by dotted lines in FIG. 13. The remaining components may then be collapsed for storage, with the support legs, beneath cover member 78 as previously described.

The scope of the invention is to be construed in accordance with the substance defined by the following claims.

What is claimed is:

1. A combination binder/book rest, comprising:
(a) a spine;
(b) front and rear covers pivotally connected along opposed edges of said spine;
(c) cover support means pivotally connected to said front cover for supporting said front cover at a selected angle of inclination relative to said spine and rear cover;
(d) page retention means rotatably connected to said spine for bearing against pages of a book supported by said inclined front cover; and,
(e) a three-ring loose-leaf binding structure coupled to said spine.

2. A combination binder/book rest as defined in claim 1, further comprising adjusting means for adjusting said angle of inclination.

3. A combination binder/book rest as defined in claim 2, wherein said adjusting means comprises a flexible membrane connected between said front cover and said cover support means.

4. A combination binder/book rest as defined in claim 3, wherein said cover support means comprises a planar member.

5. A combination binder/book rest as defined in claim 4, wherein said adjusting means further comprises first and second members connected through said planar member and through said flexible membrane for slidable movement of said first member over one surface of said planar member and for slidable movement of said second member over an opposed surface of said flexible membrane to vary the distance said flexible membrane extends between said front cover and said second member.

6. A combination binder/book rest as defined in claim 4, further comprising:
(a) a three-ring loose-leaf binding structure; and,
(b) releasable coupling means for releasably coupling said binding structure to said spine.

7. A combination binder/book rest as defined in claim 6, wherein said releasable coupling means comprises:
(a) a retaining plate fixed to said spine;
(b) a base plate fixed to said binding structure; and,
(c) means for slidably engaging said base plate with said retaining plate.

8. A combination binder/book rest as defined in claim 7, wherein said slidable engaging means comprises a pair of tabs on said retaining plate and a pair of protrusions on said base plate, whereby said protrusions may be slidably aligned beneath said tabs to hold said base plate on said retaining plate.

9. A combination binder/book rest as defined in claim 2, wherein said page retention means comprises first and second arms rotatably connected near opposed ends of said spine for movement between storage positions in which said arms overlie said spine and operating positions in which said arms project outwardly from said spine.

10. A combination binder/book rest as defined in claim 9, further comprising first and second support legs pivotally coupled to said respective first and second arms for supporting said arms away from a support surface when said arms are in said operating positions.

11. A combination binder/book rest as defined in claim 9, wherein said page retention means further comprises first and second fingers pivotally connected to the ends of said respective arms for movement between storage positions in which said fingers overlie said respective arms and operating positions in which said fingers project away from said respective arms.

12. A combination binder/book rest as defined in claim 11, wherein said page retention means further comprises first and second spring clips rotatably connected between said respective arms and fingers to urge said fingers toward said spine when said arms and fingers are in said respective operating positions.

13. A combination binder/book rest as defined in claim 12, further comprising a cover pivotally connected to said spine for covering said arms, fingers and spring clips when said arms and said fingers are in said respective storage positions.

14. A combination binder/book rest as defined in claim 13, wherein said cover is further for supporting the base of said book when said arms are in said operating positions.

15. A combination binder/book rest as defined in claim 14, further comprising first and second compartments in said cover for receiving said arms when said arms are in said storage positions.

* * * * *